US008074388B2

(12) United States Patent
Trainer

(10) Patent No.: US 8,074,388 B2
(45) Date of Patent: Dec. 13, 2011

(54) SYSTEM AND METHOD FOR MEDIA DISPLAY

(76) Inventor: Charles Trainer, Ipswich, MA (US)

( * ) Notice: Subject to any disclaimer, the term of this patent is extended or adjusted under 35 U.S.C. 154(b) by 46 days.

(21) Appl. No.: 12/773,270

(22) Filed: May 4, 2010

(65) Prior Publication Data

US 2010/0237645 A1 Sep. 23, 2010

Related U.S. Application Data

(63) Continuation-in-part of application No. 12/041,083, filed on Mar. 3, 2008, now Pat. No. 7,784,206.

(60) Provisional application No. 61/310,819, filed on Mar. 5, 2010.

(51) Int. Cl.
*G09F 21/02* (2006.01)

(52) U.S. Cl. ..... 40/586; 40/590; 40/606.02; 280/47.24; 280/211

(58) Field of Classification Search ..... 40/586, 40/590, 606.02, 602, 606.01; 180/6.2; 280/47.24, 280/211, 213, 288.4
See application file for complete search history.

(56) References Cited

U.S. PATENT DOCUMENTS

| | | | | |
|---|---|---|---|---|
| 3,167,874 | A * | 2/1965 | Pogue | 40/607.03 |
| 3,986,722 | A * | 10/1976 | Patterson | 280/16 |
| 5,403,641 | A * | 4/1995 | Linville et al. | 428/113 |
| 6,416,060 | B1 * | 7/2002 | Chen | 280/1.165 |
| 6,677,021 | B1 * | 1/2004 | Barnette et al. | 428/40.1 |
| 6,843,012 | B1 * | 1/2005 | Dodd | 40/586 |
| 7,617,626 | B2 * | 11/2009 | Balscheit | 40/590 |
| 2004/0102166 | A1 * | 5/2004 | Morita et al. | 455/152.1 |
| 2005/0205310 | A1 * | 9/2005 | Pelz | 180/6.2 |
| 2006/0202439 | A1 * | 9/2006 | Kahlert et al. | 280/47.24 |
| 2007/0205241 | A1 * | 9/2007 | Mourao | 224/401 |

* cited by examiner

*Primary Examiner* — Gary Hoge
(74) *Attorney, Agent, or Firm* — Mark S. Leonardo; Brown Rudnick LLP

(57) ABSTRACT

The invention provides a media display system and method that allows a user to easily maneuver through crowded areas while providing advertisements that can be selected and altered even while the media display system is in use. According to the invention, the system operates on a regenerative breaking system that recharges the battery as the system is in brake-mode or as a result of the media display in the shape of an airfoil contributing to the regenerative breaking mechanism.

15 Claims, 5 Drawing Sheets

SYSTEM AND METHOD FOR MEDIA DISPLAY

CROSS-REFERENCE TO RELATED APPLICATION

This patent application claims priority to U.S. Provisional Application Ser. No. 61/310,819 filed in the United States Patent and Trademark Office on Mar. 5, 2010 by Charles Trainer, and is a continuation-in-part to application Ser. No. 12/041,083 filed in the United States Patent and Trademark Office on Mar. 3, 2008 by Charles Trainer, the entire contents of each are hereby incorporated by reference in their entirety.

BACKGROUND

1. Technical Field

The current disclosure relates to media display and more particularly to a media display system and method of incorporating a regenerative breaking mechanism and a display for various types of media, which can easily reach large audiences.

2. Background of the Invention

Media and signage displays are important for advertising, public art, public service announcements, and other instances where it is important to portray a message to a large group of people. Some such events where messages and/or advertisements may need to be displayed include gliding tradeshow exhibits, handheld political campaigns, self marketing, lead or pace vehicles for events that are in motion, road sports events, retail store front promotions, information services at transportation hubs, gliding exhibits in parades, and gliding tours.

A few examples of current advertising and media display methods include billboards, post bills (posters), banners, building wraps, bus shelter ads, public restroom ads, public transit ads, taxi ads, push cart ads, fly-over aircraft, pedal craft ads, walking human ads, and many other methods that reach a large variety of people. Many of these methods are stationary and others move only on roads or in the air. Furthermore, most of them are extremely costly. Unfortunately, many of these methods of advertising are commonplace and ignored by many.

Additionally, systems for sailing on land, water, or ice are propelled by the wind and generally require someone who is youthful and in good health to operate because they require balance, coordination, and strength to maneuver. These methods generally allow a person in or on a cart with wheels, skis, ice skates, boats, surf boards, long skateboards, and ice skates with the apparatus that includes a flexible sail made of a fabric or plastic sheeting. Most of the fore-mentioned sailing types require energy, endurance, and skill by the operator and cannot be performed well without hours of training.

Furthermore, systems that operate on battery power generally require that the battery is frequently recharged so that the user may operate the system on full power without worrying about the remaining duration of power in the system.

SUMMARY

Therefore, it is desirable to provide a system for media display that is easy to use, cost effective, can display media to a large group of people in a short period of time, and retains power for a period of time longer than currently used battery powered vehicles. Accordingly, a system and method for media display is disclosed.

The media display system includes a display means, generally an airfoil, that is operatively connected to a modified motorized base with wheels such as those systems provided by Segway Inc.™ of Bedford, Mass. In one embodiment, this system includes a two wheeled base configured for a operator to stand on, a steering column operatively connected to the base, a display means in the shape of an airfoil for a user standing on the base to hold and steer, a handle means operatively connected to the display means, a connection bar that is operatively connected to both the base and the display means, at least one wheel operatively connected to the media display such that the media display system can move 365 degrees, and a regenerative breaking system that recharges power to the media display when the media display system is in brake-mode or when the display is propelled by the wind. The base and steering column can be a modified Segway™ device.

In another embodiment, this system includes a two wheeled base configured for a operator to stand on, a steering column operatively connected to the base, a display means for a user standing on the base to hold, a handle means operatively connected to the display means, an extension bar that is operatively connected to both the base and display means, at least one wheel operatively connected to the media display such that the media display system can move 365 degrees, a steering mechanism by which the user can steer the base with the use of his knees, a mechanism that regenerates the battery of the base while the user operates the system, and a media display that is in the shape of an airfoil to provide for aerodynamic movement of the device and to recharge the battery of the system. The base and steering column can be a modified Segway™ device.

A method of advertising is also provided. The method includes the steps of standing on a modified Segway™ device, holding a media display having a wheel operatively connected to the display means such that the media display system can move 365 degrees, holding a handle operatively connected to the media display at approximately waist or shoulder level of an operator, displaying a message electronically on the media display, the operator carrying a smartphone that can receive instructions over the smartphone from a remote location that can then alter the message displayed on the media display in real time, and displaying advertisements on the media display.

DETAILED DESCRIPTION OF THE INVENTION

Figure 1A:
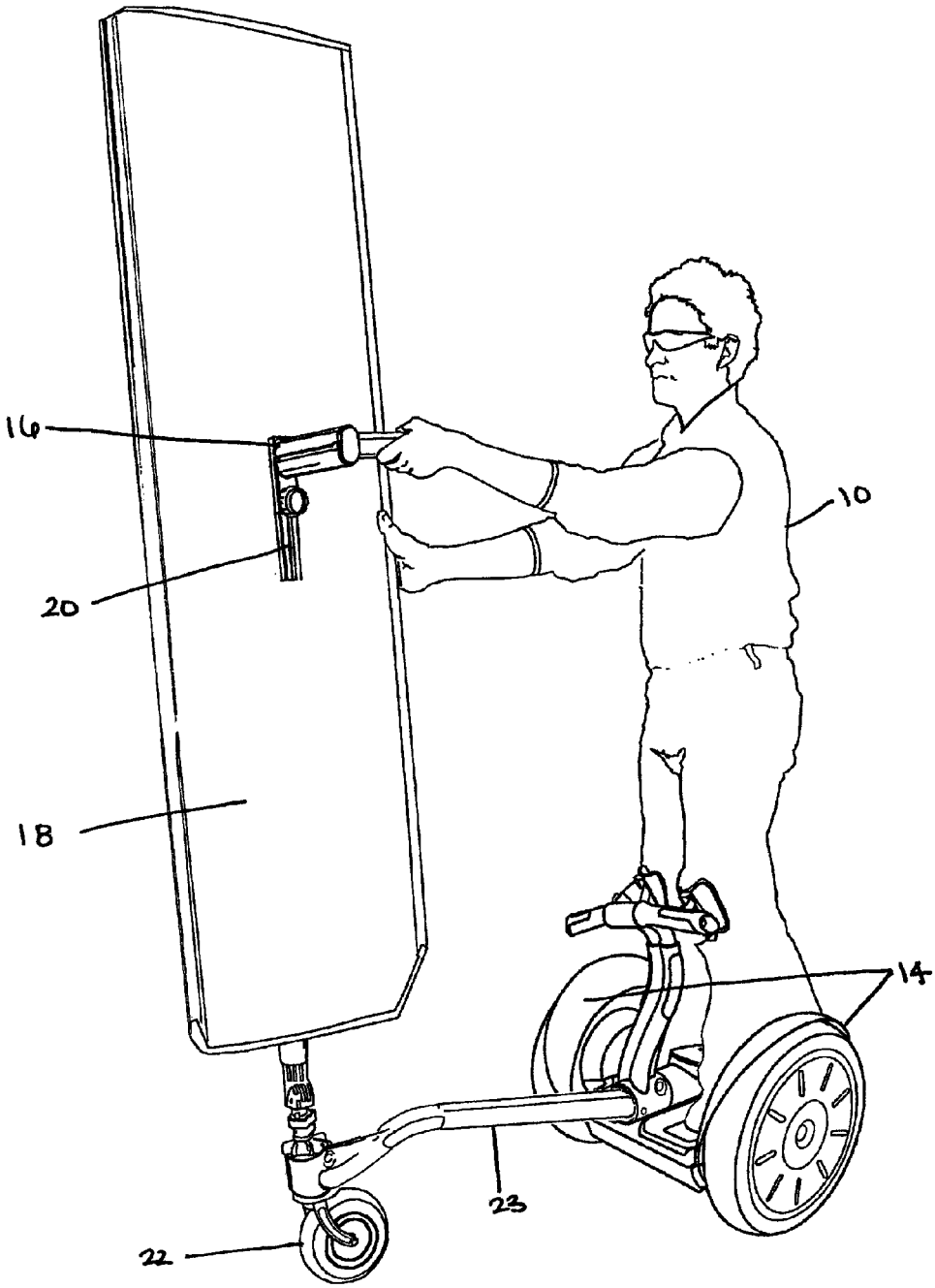
FIGS. 1A and 1B are perspective views of an embodiment of the system according to the present disclosure.

Many known systems and methods for media display can only be operated outdoors and on smooth flat services. Also, many of the devices currently known require a lot of space as they need large areas to make turns and/or move. Thus, a system and method that can be used in small spaces, near large public buildings, or has the ability to go off-road is desirable.

It is envisioned that the system and method according to the present disclosure can be used in a variety of locations including outdoor sporting and public events on cut grass, hard packed sand/dirt, and semi-loose gravel. Furthermore, the system may be used at a large variety of events including: The Olympics™, PGA™ golf tournaments, pre-game promotion at large outdoor field sporting tournaments, large outdoor concert series, outdoor public markets, outdoor creative arts festivals, large political outdoor gatherings, at the waters edge at large boating races, or any event that occurs off-road.

The system allows a message to reach large groups of people in a short period of time. The advertising system allows for operation in large public buildings, in small spaces, or in areas that are not flat, hard, or smooth. The system can also utilize steer technology of the customized Segway i2™, which allows the operator to control with their feet, knees, and legs only, which reduces clutter and provides a sleek look and an unobstructed tacking area for the media display.

The transporter utilizes lean steer technology as the method of controlling the direction of travel such that leaning or banking the deck causes the wheels to steer. Leaning the handles or the attachment on the steering column of the base with either the user's hands, bodyweight, or knee directionality, to the right causes the wheels (relative to the direction of travel) to steer to the right (e.g. toward the inside of an upcoming turn). The reverse is also true in that leaning the deck to the left causes the wheels to steer to the left.

In one embodiment, in a handlebar lean machine, the yaw input is proportional to the handlebar angle with respect to the frame, the chassis. Preferably, the pivot axis is mounted as low as practical on the transporter ground-contacting module in order to allow the bar motion to follow the users body motion naturally, since a person leans most stably by pivoting at the ankles. In other words, a low pivot handlebar tracks the body's kinematics. In this embodiment, the yaw input is converted into a yaw command using standard personal transporter algorithms, which apply a fixed gain to yaw input at low speeds, but scale the gain at higher speed to make the yaw input correspond to lateral acceleration instead of yaw rate. This works well with the handlebar lean device, since the desired lean angle is roughly proportional to lateral acceleration. The result is a very natural input method, where the user "thinks" right or left via leaning, and the machine follows.

In another embodiment, instead of a handlebar lean machine and yaw input being proportional to the handlebar angle, there is a mechanism which the user can place his knees that can be used to steer the vehicle through the use of the user's knees and lean of the user's body position.

In accordance with yet other embodiment of the invention, with the direction of travel as the reference point, the pivoted handlebar may be either mounted in the front or the rear of the transporter. The configuration of a rear mounted pivot handlebar enables a user to steer the transporter with other parts of the body such as the knees, in addition to using a limb coupled to the handlebar.

In another embodiment, the transporter may include a feature that disables the lean steer when a user is mounting or dismounting. The feature may be activated when the transporter determines that a user is partially on/off the platform such that the transporter may not turn into or away from the user while mounting or dismounting.

The transporter utilizes a regenerative breaking mechanism, also referred to as regenerative charging or sailing, by which, while the user is conducting their method of advertisement, the battery power of the base or transporter is recharged. In regenerative breaking, the electric motor applies resistance to the drive train to slow the rotation of one or more wheels. The energy from the rotation of the one or more wheels turns a motor that can charge the on-board battery.

The on-board batteries in the device may be recharged by capturing the kinetic energy created when using the brakes (referred to as "regenerative breaking" or "regenerative charging or sailing"). A regenerative brake is an energy recovery mechanism that reduces vehicle speed by converting some of its kinetic energy and/or potential energy (due to elevation) into a useful form of energy instead of dissipating it as heat, as with a conventional brake. The converted kinetic energy is stored for future use or fed back into a power system for use by other vehicles.

In one embodiment, when the user is utilizing the breaking mechanism of the device, the battery of the device is recharged. In another embodiment, when the device is propelled in one direction by the wind, or the wind directionality changes, the device is recharged. In this embodiment, the term may not be referred to as regenerative breaking, but rather regenerative charging or regenerative sailing. In another embodiment, when the user is going uphill, the battery power of the device is recharged. The same mechanism that is utilized in regenerative breaking can be used in regenerative charging or regenerative sailing when the device is pulled or pushed by the blade because of the position of the wind on the display.

In another embodiment, regenerative breaking or charging system is connected through a connection to the on-board battery. While the vehicle is breaking, the regenerative breaking system converts the kinetic energy from the moving vehicle into electrical energy, as is known in the art, such as is discussed in U.S. Pat. No. 7,322,659, Finch et al., Method and System for Brake Distribution in a Regenerative Breaking System that is hereby incorporated by reference. The regenerative breaking system delivers this recaptured electrical energy preferably to the power battery through the connection at the current and the voltage. Unlike the regenerative breaking system described above, the current invention also uses regenerative charging or sailing whereby when the vehicle is pulled or pushed, due to the wind resistance on the airfoil display, the system converts the kinetic energy from the moving vehicle into electrical energy. The system delivers the recaptured energy to the on-board battery through a connection at the current and the voltage.

In a typical situation, the breaking mechanism in the vehicle is accomplished with a combination of breaking systems. For example, breaking is accomplished with a friction breaking system and an electro-mechanical breaking system that at least partially utilizes the regenerative breaking system. When these two systems are combined, vehicle stability is desirable and the amount of recaptured kinetic energy is maximized.

Regenerative breaking, such as is used on hybrid gas/electric vehicles to recoup some of the energy lost during breaking, is also similar to the regenerative charging or sailing mechanism. The energy saved as a result of the vehicle breaking, being propelled by the wind, or driving uphill is stored in a storage battery and used later to power the vehicle when necessary. But regenerative breaking does more than simply stop the vehicle. Electric motors and electric generators (such as a vehicle's alternator) are essentially two sides of the same technology. Both use magnetic fields and coiled wires, but in different configurations. Regenerative breaking systems take advantage of this duality. Whenever the electric motor of a vehicle begins to reverse direction, it becomes an electric generator or dynamo. This generated electricity is fed into a chemical storage battery and used later to power the vehicle.

Regenerative breaking takes energy normally wasted during breaking and turns it into usable energy. It is not, however, a perpetual motion machine. Energy is still lost through friction with the road surface and other drains on the system. The energy collected during breaking does not restore all the energy lost during driving. It does improve energy efficiency and assist the main alternator.

The current invention provides that the display of the device is in the shape of an airfoil to facilitate ease of movement as well as propel the device and contribute to the regenerative breaking/charging mechanism described earlier. The effect of having the media display in the shape of an airfoil is that it results in more propulsive force and correspondingly more speed.

An airfoil has a pulling or pushing effect, dependent upon the wind and the steering conducted by the user of the device. When the airfoil is connected to the base of the media display system, wind provides drag over the airfoil which then propels the base in a direction that is generally forward. The direction of the airfoil can be at any angle as long as the base is propelled in a forward or backward direction. As the media display system is propelled, the electronic circuitry in the system will start recharging the battery, as previously explained.

Hence, by way of example, when wind is applied to the airfoil from any direction, the airfoil will have drag and then propel the device in that direction. For example, FIG. 4 shows if the wind travels in Y direction, the device can be pulled in X direction, thus instituting the regenerative process and recharging the battery of the system.

Figure 4:
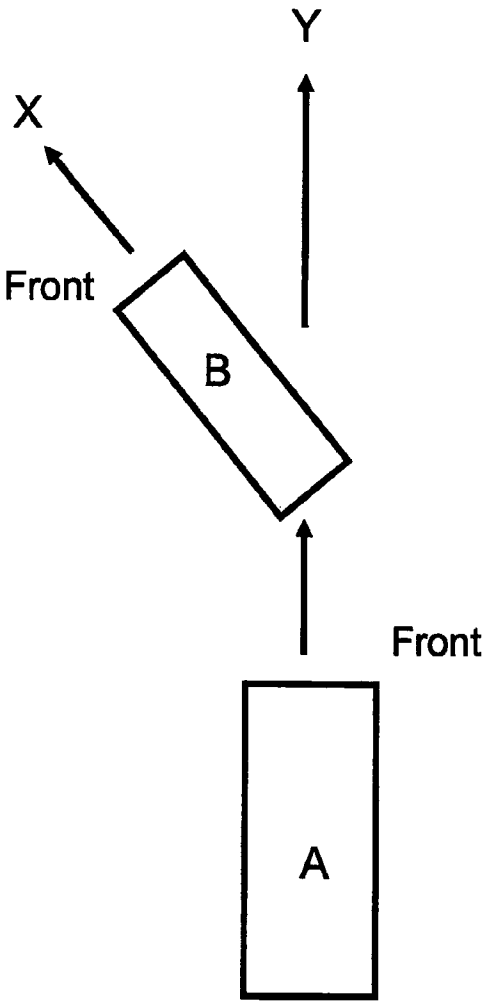
FIG. 4 is a perspective view of an embodiment of the system where the directionality of the base and display are different.

As is shown in FIG. 4, in this aspect, the forward or front end of the media display can be travelling in one direction, Y while the forward or front end of the transporter base can be pointed in another direction, X. Therefore, the front of the media display and transporter base are travelling in two different directions even though they are driven by wind travelling in one direction.

To produce both flow-deflection as well as the circulation required for lift, the trailing edge of an airfoil must be fairly sharp. Whenever the trailing edge of an airfoil causes air to move to one side or the other, two other things occur. First, the air ahead of the airfoil will move over the leading edge of the airfoil. Second, the air on one side of the airfoil will speed up, and the air on the other side of the airfoil will slow down. Each fast-moving parcel of air on one side of the airfoil greatly outraces its counterpart flowing on the other. Air divided by the airfoil doesn't rejoin again, instead a narrow region of fast flowing air appears on one side the airfoil, and a wide region of slow air appears on the other.

The difference in pressure on each side of the airfoil creates a "lifting force" or "drag" that contributes to the regenerative breaking, charging, or sailing system of the device. As the user is holding on to the airfoil display device to stabilize the display in one direction or another, dependent upon the wind direction, the drag created by the airfoil results in the regenerative breaking, charging, or sailing mechanism of the device to be triggered and recharging of the battery of the system to begin.

In one embodiment where the media display is a flexible material, as wind passes around the airfoil, negative pressure is induced out front of and on the side of the airfoil that the wind is blowing. This in turn causes surrounding air to rush into the display and propel the device further based on the acceleration caused by the wind. This airfoil action is compounded as the device travels faster, the wind around the display creates more negative pressure, causing the device to travel faster, causing more negative pressure, and so forth. The user of the device may guide the display by steering the column attached to the display. The drag that is created by the pressure and surrounding air contributes to the regenerative breaking, charging, or sailing mechanism of the media display system.

The method and system according to the present disclosure incorporates a tighter turning radius to improve mobility, especially in small areas. Furthermore, the system is easy to operate and takes less endurance strength.

A connection bar is mounted between the base of the transporter and the airfoil display device to provide maximum stability but also flexibility, if needed by the user of the device. The bar provides for stability, facilitates turning, allows the user to steer the entire device without using their hands or handle connected to the airfoil or display. The connection bar provides additional safety and rigidity. A variety of alternatives exist for where the connection bar is most beneficial, dependent upon the intended use of the media display device.

In one embodiment, the connection bar is mounted at the base of the transporter at one end and the base of the media display, above the wheel, at the other end.

In an alternative embodiment, the user may desire to have the bar mounted at the base of the transporter at one end and at approximately knee-level on the end of the media display. The position of the connection bar on the display is dependent upon the user's preference, the terrain on which the device will be used, and the wind speed on the day the device will be used.

The connection bar can be rigid in size, extendable, or expandable. The connection bar can be made of any material to support the rigidity or flexibility needed by the user of the device. The connection bar may be made of metal, plastic, or a spring-like substance to provide for absorption of movement of the device and base in alternate directions or any directionality of the transporter.

In an alternate embodiment, the bar can be flexible, bendable, or pliable to allow for limited sway or movement depending upon the road or ground conditions.

In an alternate embodiment, the connection between the transporter and display can be made up of one or more strut-like members, instead of a single bar.

Figure 1B:
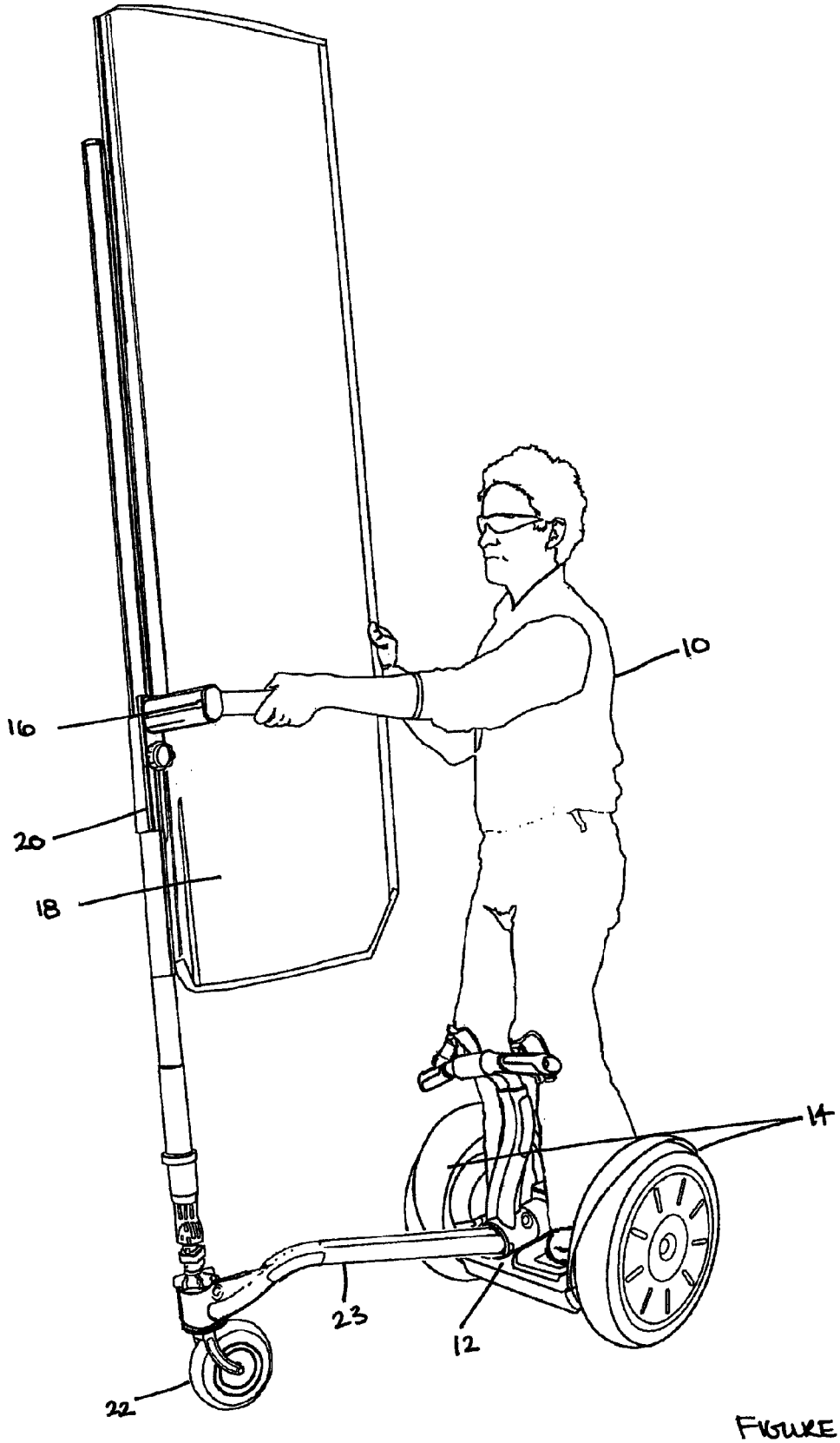

Now turning to the figures, FIG. 1A and FIG. 1B, depict an exemplary embodiment according to the present disclosure. An operator 10, stands on a base 12. Base 12 is operatively connected to wheels 14 via a connection bar 23. The base 12 and wheels 14, can be a Segway device as provided by Segway™ Inc. The operator 10 holds handle 16. Handle 16 is operatively connection to display means 18. There may be a track 20 in display means 18 such that handle 16 slides into track 20 to allow the connection. A gurney wheel 22 is attached to the bottom of media display 18. Wheel 22 allows for 360° rotation. Wheel 22 can be a small wheel or large wheel depending on the terrain where the system is being used. This allows operator 10 to maneuver the device in a variety of directions and turn the device quickly and precisely if needed. This particular embodiment allows for three points, a tripod styled base/foundation of support that allows for freedom of movement and stability of the operator. Base 12 allows for the operator to stand on and provide the operator with a way to move the display means 18 without standing on the ground. Both drive systems (Segway™ i2 & x2 models) that can be used, among others, as base 12 can be propelled in a variety of different directions. This system also allows the operator to maneuver display means 18 to meet the sight lines the audience placement around the display demands of any given project.

Figure 2:
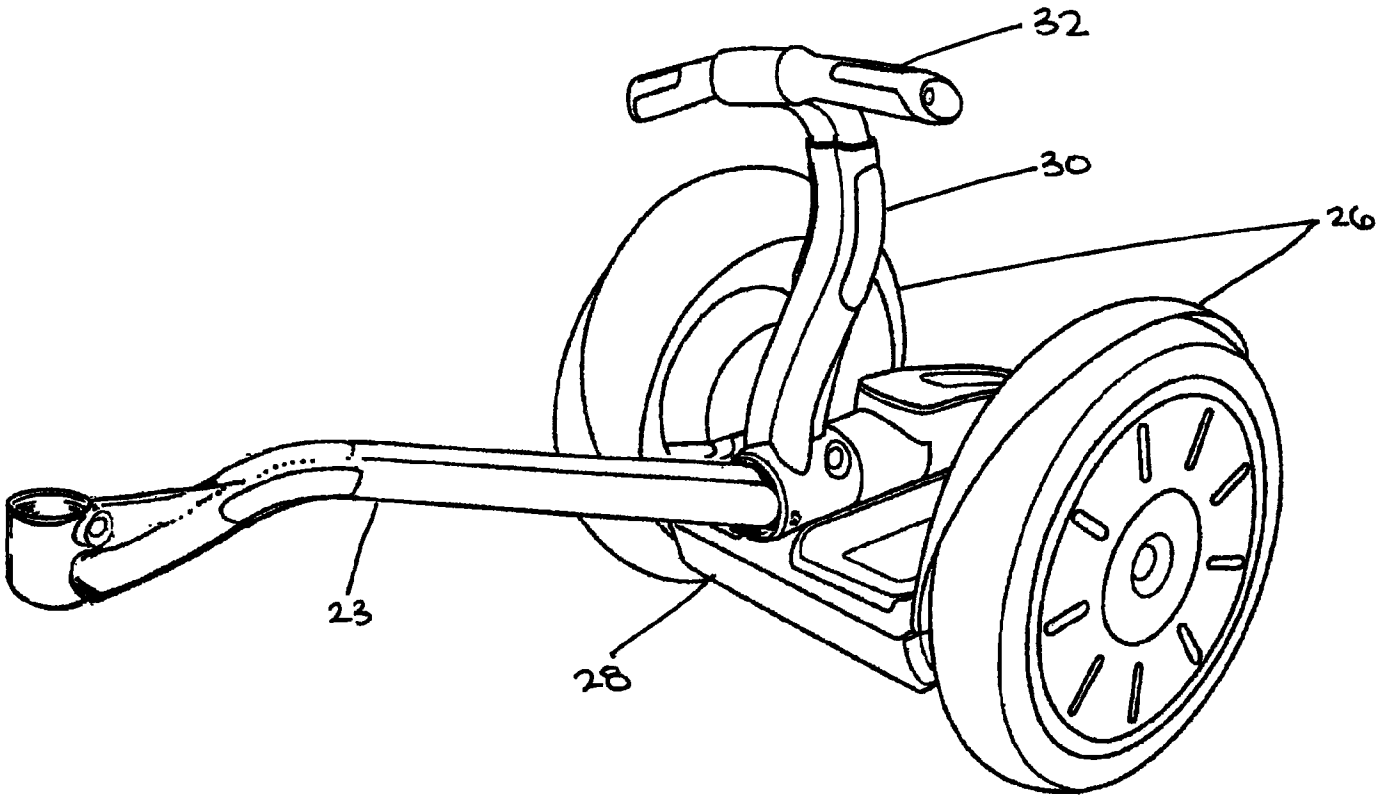
FIG. 2 is a perspective view of the base and wheels portion of one embodiment of the system according to the present disclosure.

FIG. 2 shows the base and wheels portion of the system according to an exemplary embodiment with the connection bar 23 that can be mounted between the base and the display mechanism of the device. In this embodiment, a modified Segway device is used. The Segway incorporates Segway Smart Motion™ and is controlled by a network of sensors, mechanical assemblies, propulsion, and control systems. Via lean steer technology, an operator uses his or her body position to move and steer the Segway device. The Segway device shown in FIG. 2 has wheels 26, connection bar 23, and base 28. A steering column 30 is shorter than the standard Segway device in this embodiment. This modification of the Segway devices allows for the user to effectively steer the media display system without the use of their hands. The handles 30 are in a reverse position from a standard Segway device to allow the user to use their knees to help maneuver the system.

Figure 3:
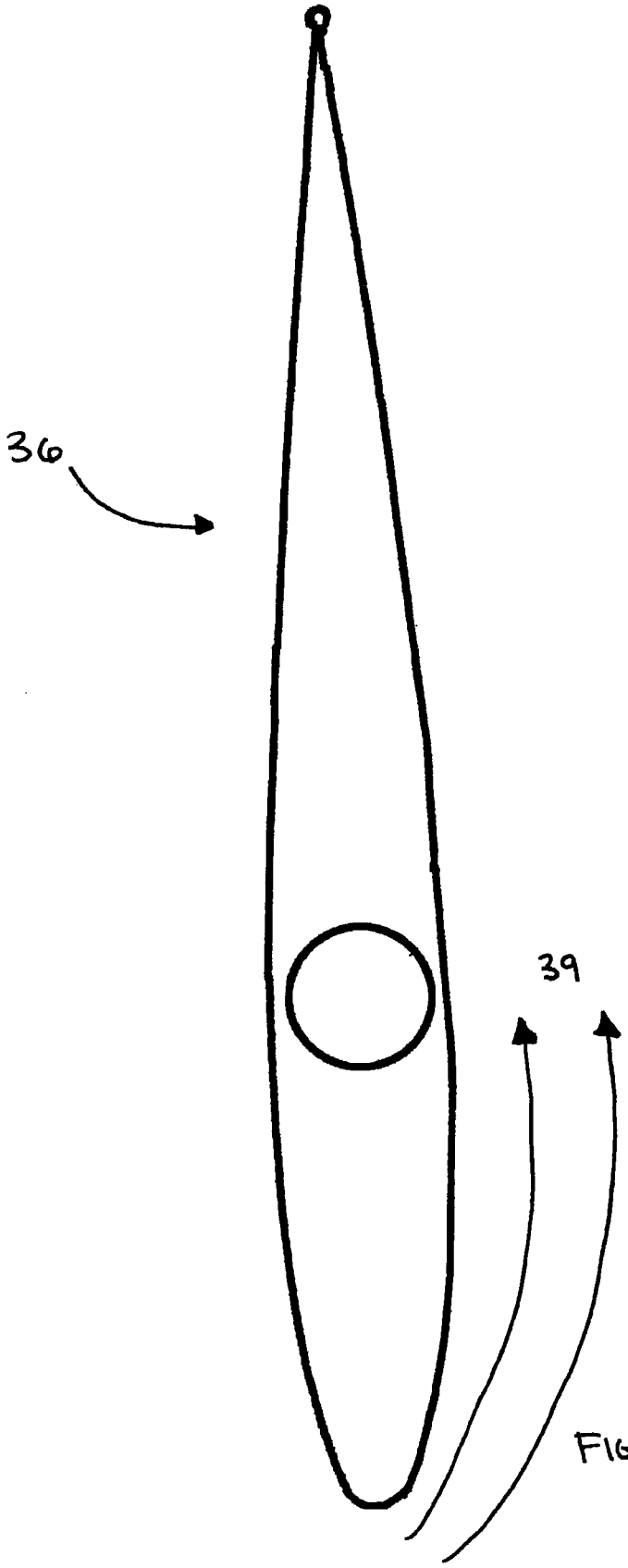
FIG. 3 is a bottom view of the mast of an exemplary embodiment according to the present disclosure.

The media display, such as an airfoil, is shown in FIG. 3. FIG. 3 is a bottom view of the media display 36. The media display structure 36 may be constructed with an internal mast, surrounded by sign foam and a hard skin made of fiberglass. In one embodiment, media display 36 sub-finish is a under laminate reflective sheeting (from, the 3M Corporation™ of St. Paul, Minn.) called Scotchlite® brand, (White color) DiamondGrade® sheeting. This is an energy efficient non-illuminated system that is iridescent during the day light and highly reflective at night. The media display 36 can be can be double sided and the convex surfaces may be highly visible from a wide viewing angle. The artwork can be printed and applied on top of the reflective surface. In one embodiment, the media display 36 is printed (vivid digital printing: (4) four color, up to (6) six color, inkjet press using solvent inks for long life) on clear cling graphic film. The printed media (the final over laminate) allows for great variety of images and/or advertising to be displayed. The media display 36 can display large or small messages and allows for many people to see the message from a distance.

FIG. 3 shows a media display 36 that is an airfoil and can generate drag and contribute to the regenerative breaking or sailing system of the device, as described above. Wind 39 directionality creates drag on the airfoil which can cause lift and connect back through the circuitry, in one embodiment contained within the connection bar between the airfoil and base, to the battery to regenerate the battery's power. Wind 39 accelerates over one surface of an airfoil, either because it is at an angle to the flow, or because it has more curvature than the other side, or both. When air is accelerated, the pressure that it imparts on an adjoining surface decreases. This lower pressure pulling upward on the upper surface of an airfoil produces lift or drag. In another embodiment the drag created by the airfoil alone is a sufficient breaking mechanism by which the regeneration of the battery needs no connection back to the battery.

In another embodiment, the media display 36 allows for the advertisement or message to be electronically displayed. Thus, media may be dispatched and monitored from the computer of an advertising account executive, using real time Collaboration Technologies Incorporated (CTI Inc.™) software via FTTP over the Internet and/or cellular phone networks, finally arriving through a wireless handheld onboard or through a similar connection to the system according to the present disclosure.

The operator of the media display 36 can control distribution and an IT system can track performance data from the field automatically. The operator may also interact with viewers. Thus information can be compiled and the file data can be transmitted. The operator can manually track interactions data on a preplanned schedule. A final summary report can be sent via e-mail at the end of the project.

In another embodiment, the media display 36 can be changeable to allow for ease of changing the advertisement or message. One such changeable media display 36 can include electronic paper such as that provided through E INK Corporation™. E paper technology is thin, light, flexible and updated by wireless connectivity via local hot spots made possible from Plastic Logic™.

In an alternate embodiment, the media display 36 may be electronic signage such as an LCD light that illuminates without the use of energy. Indicia or advertisements can be displayed on the airfoil and can be changed or alternated in real time through messages or directions sent via a smartphone. For example, if an advertiser who is paying for the display of indicia or an advertisement on the airfoil would like to change what is displayed on the airfoil during the time the device is in use, the advertiser may log on to their computer, upload a message and send the signal to a smartphone. The signal received by the smartphone, and utilized by the operator of the device, will receive the signal and change the indicia that is displayed on the airfoil.

In another embodiment, the media display 36 can be mounted on a mast that is operatively connected to the base and wheels rather than only being connected to the base by way of the operator. For example, there can be a permanently or removably mounted c-channel extrusion running up the mast and a permanently or removably mounted kerning, flexible solid tube wrapped in a fiberglass cloth type hinge, to the airfoil or display means. The media display 36 can have free-swinging forward leaning media that can automatically turn, on level grades, in the direction of the transporter as it turns. This is desirable for maximum visibility while moving around corners or navigating around objects.

FIG. 4 depicts an embodiment where the front end of the base A and the front end of the display B are pointed in two different directions, Y and X respectively. Even with the connection bar present between the base and the display, they are still able to move in different directions. FIG. 4 depicts that while A is moving in Y direction, the trajectory of B is in X direction, instead of Y direction like the base. This is desirable for maximum versatility of the user during display for turning in tight corners, maneuvering around pedestrians and observers, obtaining maximum advantage of wind gusts during use of the device, and provide for maximum resourcefulness of the device. Further, the difference in directions on the base of the device and the display contribute to the regenerative breaking or sailing mechanism of the device.

The system also can include a variety of features to allow for Bluetooth communication and/or digital camera features. For example: such as an iPhone™ from Apple, Inc. can be included in the media display system. From the Segway i2 & x2 the Info Key™ can be remounted at eyelevel on the media air foils hardware (arm/handle). This Info Key™ is the Segway's Bluetooth wireless controller. Other embodiments can include CPU with WIFI connection and real time collaboration web based software technologies, etc.

Many modifications to the system according to the present disclosure are contemplated. Other accessories that can be used with or on the media display system according to the present disclosure. These accessories include, but are not limited to, media display travel bag for shipping, hard travel case for shipping of Segway Transporter base and Eco Ads LeanSteer™ quick connector, Segway Hard Cases by GM® for storage of hand out materials, Segway 5 Watt LED Lithium-ion Lighting Kits™ for night time operations, Bose™ Corp. mini satellite (wireless) sound systems for broadcasting audio, Segway i2 Lower Cargo Frame Kit for mounting PA, AV and lighting equipment, Segway Ramp Kit™ for loading into a vehicle, Segway LeanSteer Frame Tool-less Release™ for easy and fast set-ups, Segway Locking Kit™ for added security, and Segway Comfort Mats™ for alleviating fatigue on long days.

When an operator desires to operate the system according to the present disclosure, the operator starts the Segway with the InfoKey, and then raises the display means, air foil to a balanced upright position with its wheel touching the Segway. The operator holds onto the handle located on the media display with one hand. The operator holds onto the edge on the display means with the other hand and finds the lower pivot point to adjust the balance of the display means. There may be an indicator light that signals when it is safe for an operator to step on such as after the (RED) status LED's change to (GREEN) status. Then the operator steps onto the base while still holding the display means. The operator used his or her feet to propel the device forward. The operator drives the device using the steering shaft and operates the Segway with (his or her), legs and feet.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A media display system comprising:

a two wheeled base configured for an operator to stand on;

a modified steering column operatively connected to said base such that an operator can use knees to facilitate directing the system;

a media display for a user standing on said base to hold and steer, said media display substantially in the shape of an airfoil allowing messages to be displayed;

a connection bar operatively connected to said base and to said media display;

a handle means operatively connected to said media display;

at least one wheel operatively connected to said media display such that said media display can move 365 degrees, and wherein said media display can move in a direction different from said base; and a regenerative breaking system, wherein use of a breaking mechanism of said base recharges a battery housed within said base.

2. The media display system according to claim 1, wherein said base and steering column are a modified Segway device.

3. The media display system according to claim 1, wherein said media display includes an electronic media display that displays different messages over time.

4. The media display system according to claim 3, wherein said electronic media display can be altered in real time, sent over the Internet, and received through a smartphone.

5. The media display system according to claim 1, wherein said connection bar is adjustable in length and direction.

6. The connection bar according to claim 5, wherein said connection bar is flexible.

7. The media display system according to claim 1, wherein said battery is recharged by said regenerative breaking system using wind power generated by airflow flowing over and around said media display.

8. The media display system according to claim 1, wherein said media display is substantially covered with laminate reflective sheeting.

9. A media display system comprising:

a base configured for an operator to stand on, two wheels rotatably connected to said base, a modified steering column connected to said base such that an operator can direct said system in a hands-free manner;

a media display, said media display substantially in the shape of an airfoil wherein said media display includes an electronic media display that displays different messages over time, wherein the message on said media display can be altered in real time, sent over the Internet, and received through a smartphone to alter the messages on said media display;

a handle means operatively connected to said media display;

a wheel operatively connected to said display means such that said media display can move 365 degrees, wherein a forward end of the base can be traveling in one direction while a forward end of the media display can be pointed and traveling in another direction; and a regenerative breaking system, wherein use of a breaking mechanism of said base recharges a battery housed within said base.

10. The media display system according to claim 9, wherein said base and steering column are a modified Segway device.

11. The media display system according to claim 9, wherein said media display is operated by use of the operator's knees.

12. The media display system according to claim 9, wherein an angle of the operator's body controls the directionality of said base while the system is in use.

13. The media display system according to claim 9, wherein said battery is recharged by said regenerative breaking system using wind power generated by airflow flowing over and around said media display.

14. A method of advertising, comprising the steps of:

standing on a two wheeled base operatively connected to a media display;

holding said media display having a wheel operatively connected to said display means such that said media display system can move 365 degrees;

holding a handle operatively connected to said media display at approximately shoulder level of an operator;

displaying a message electronically on said media display;

carrying a smartphone wherein said smartphone receives remote instructions to alter said message in real time displayed on said media display; and displaying media on said media display.

15. The method of advertising according to claim 14, wherein said two wheeled base is modified such that said base can be operated in a hands-free manner.

* * * * *